United States Patent [19]

Jung

[11] 4,318,362

[45] Mar. 9, 1982

[54] FLOATING CONCRETE DOCK

[76] Inventor: Henry W. Jung, 18611 Sandy Rd., Castro Valley, Calif. 94546

[21] Appl. No.: 160,113

[22] Filed: Jun. 16, 1980

Related U.S. Application Data

[63] Continuation of Ser. No. 895,975, Apr. 13, 1978, abandoned.

[51] Int. Cl.[3] ..... B63B 35/00

[52] U.S. Cl. ..... 114/266; 114/263

[58] Field of Search ..... 114/266, 263, 65 A, 114/264, 265, 258, 267; 14/27; 405/219, 220, 221, 218; 16/128 R, 137, 138; 9/8 P, 8 R; 52/414, 586, 587, 583

[56] References Cited

U.S. PATENT DOCUMENTS

| | | | |
|---|---|---|---|
| 1,908,714 | 5/1933 | Schneider | 14/27 X |
| 2,596,416 | 5/1952 | Kornmayer | 16/128 R |
| 2,879,735 | 3/1959 | Pointer | 114/266 |
| 3,022,759 | 2/1962 | McCall | 114/266 |
| 3,083,665 | 4/1963 | Steidley | 14/27 X |
| 3,091,203 | 5/1963 | Usab | 114/266 |
| 3,616,774 | 11/1971 | Thompson | 114/266 |
| 3,726,098 | 4/1973 | Alms et al. | 114/266 |
| 3,779,192 | 12/1973 | Gonzalez | 114/266 |
| 3,799,093 | 3/1974 | Thomson | 114/266 |
| 3,897,741 | 8/1975 | Martini | 114/266 |

FOREIGN PATENT DOCUMENTS

| | | | |
|---|---|---|---|
| 1581471 | 2/1968 | France | 405/219 |
| 381555 | 10/1964 | Switzerland | 16/128 R |
| 118309 | 8/1918 | United Kingdom | 114/65 A |
| 1274268 | 5/1972 | United Kingdom | 16/128 R |

*Primary Examiner*—Douglas C. Butler
*Attorney, Agent, or Firm*—Harvey G. Lowhurst

[57] ABSTRACT

A floating concrete dock comprised of floating units such as headers and fingers with the fingers depending outwardly from headers and connected to one another by continuous hinges. Each floating unit includes a deck portion and a pair of stem portions depending downwardly from the lower surface and spaced inwardly from the side edges of the deck portion and defining a double-T (channel beam) section with a channel between the stem portions, and buoyancy material disposed in the channel. The deck portion and the stem portions have longitudinal tension rods for maintaining the entire floating unit under longitudinal compression.

8 Claims, 8 Drawing Figures

FLOATING CONCRETE DOCK

This application is a continuation, of application Ser. No. 895,975, filed Apr. 13, 1978 now abandoned.

BACKGROUND OF THE INVENTION

This invention relates to floating docks comprised of one or more floating units, such as headers and fingers, constructed essentially of prestressed reinforced concrete and joined together to form a composite dock having a continuous deck and an arbitrary configuration.

Floating docks constructed of prestressed reinforced concrete float units are known. For example, see U.S. Pat. No. 3,022,759 which issued on Feb. 27, 1962, to McCall for Concrete floating Wharf. One of the advantages of concrete floating dock units is that they are well suited to resist the deteriorating action of water, especially salt water, and one of the advantages of utilizing prestressed reinforced concrete is flexibility. Prior composite dock units of this type, as explained in the above referenced patent, comprise horizontal, resilient slabs, also referred to as decks, of prestressed reinforced concrete and pontoons rigidly connected to the underside of the slabs to provide floatation.

One of the problems with such prior art composite docks is that their length is limited, inter alia, because of the flexibility of the slab. For example, when the slab has floatation pontoons attached to its lower surface at points about one quarter slab length from each end, the center portion and the end portions are unsupported and will sag. Further, and more importantly, the wave action will produce enormous stresses on the slab with severe displacement of the unsupported and cantilevered slab portion. To prevent such sagging and wave action motion of slab portions, either the slab must be made thick enough so that it loses some of its flexibility, or the length of the slab must be short enough to prevent excessive bending. Further, the flexibility of such a prior art slab does cause hairline cracks in the cement which allows water, and particularly salt water, to reach the prestressed tendons causing the same to deteriorate under the corrosive action of the water.

It is therefore a primary object of the present invention to provide a concrete floatation unit that is longer in length, per unit, than was possible heretofore which results in greater economy since the cost of a larger unit is less than the cost of two units each one-half of the length of the larger unit.

It is another object of the present invention to provide a concrete floatation dock unit which has a weight per unit length which is less than those of prior art units and therefore more economical to fabricate and to transport to the dock area.

In another object of the present invention to provide a concrete floatation unit for assembling into a dock which is rigid to prevent the formation of hairline cracks and the resulting exposure of the tendons to the corrosive action of the sea water, which is economical and which allows assembly with additional floatation units.

It is a still further object of the present invention to provide concrete floatation units which allow for the installation of a dock in areas in which docks could heretofore not be installed due to high wave action and which are sufficiently strong to withstand such wave action.

It is another object of the present invention to provide a means of connecting concrete floatation units to one another which is flexible, economical and very secure against dislodgment, and which is well able to withstand lateral forces, such as are caused by flooding and by the tides and by wind forces acting against boats tide thereto.

SUMMARY OF THE PRESENT INVENTION

In accordance with the present invention, a floating concrete dock is constructed of a plurality of floatation units, such as headers and fingers, which are connected to one another. Each floatation unit includes a deck portion and a pair of inwardly spaced and downwardly depending stem portions defining a channel with the underside of the deck portion which is filled with a floatation material. The deck portion and the stem portions are precast include longitudinal tensioning means for maintaining the floatation unit under longitudinal compression. A coating of concrete or an elastoplastic material covers the portion of the buoyancy material exposed to the water and adjacent units are fastened together by a continuous hinge which extends entirely across the common width of the edges the units being fastened to one another.

DETAILED DESCRIPTION OF THE DRAWINGS

Figure 1:
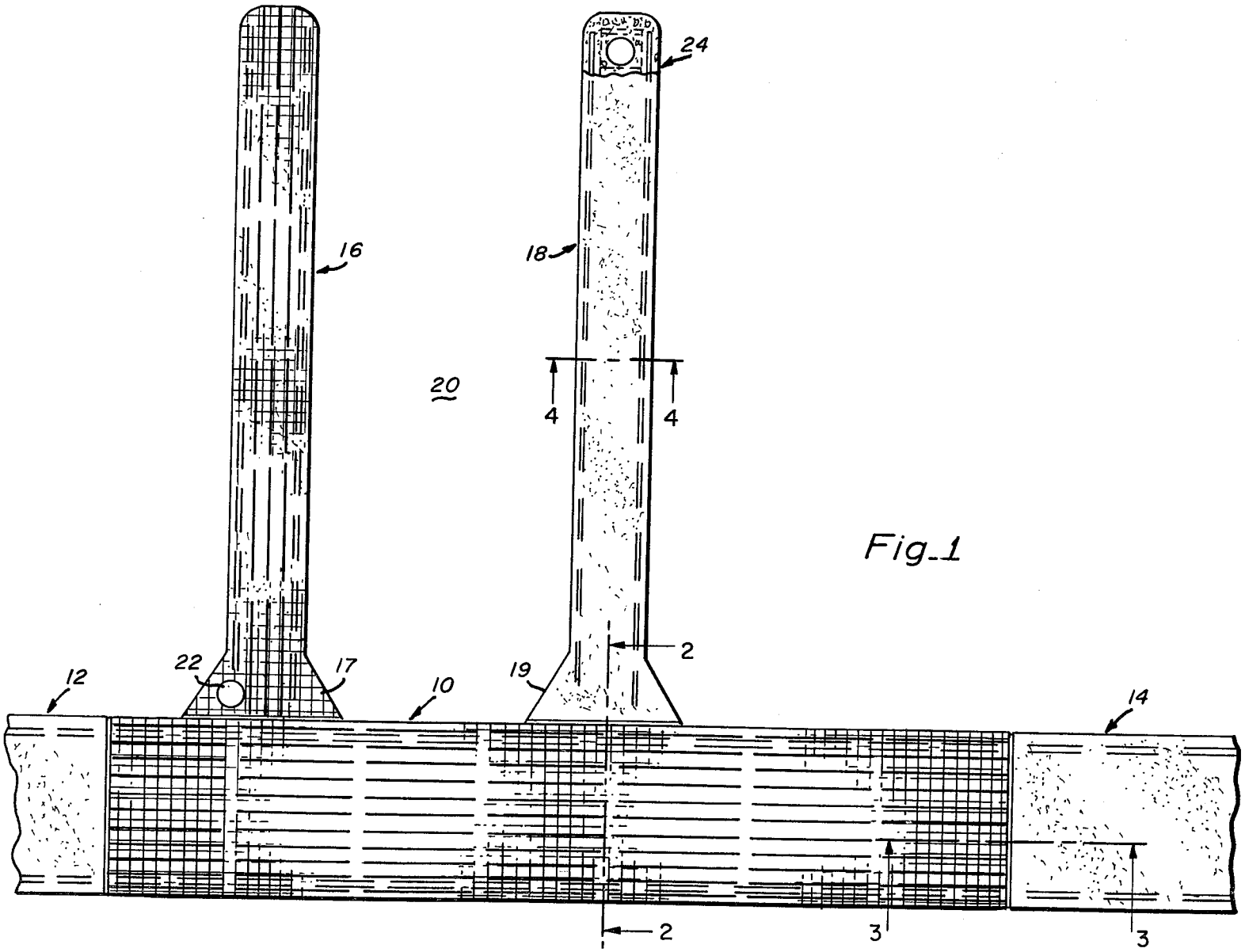
FIG. 1 is a plan view of a portion of the floating concrete dock of the present invention showing one center header (shown in full view) having attached to each end thereof another header (shown in partial view) and two fingers attached to the side of the center header.

Referring now to FIG. 1 of the drawings, there is shown a fragmentary view of a floating concrete dock comprised of a header 10, hinged on one end to a header 12 and on the other end to a header 14, the last two headers being shown only in part. Further, there is shown a pair of fingers 16 and 18, having triangular enlargements 17 and 19, respectively, with the enlarged end portion of the fingers being hinged to one side of header 10. Generally speaking, the headers form the primary walkways of the dock structure and the fingers, depending sideways from the headers, forming between them the docking slips, as indicated at 20. As will become better understood hereinafter, the construction and configuration of the headers and the fingers is substantially the same as shown by the cross-sectional views of FIGS. 2 and 4, except that headers are physically larger than fingers, and fingers usually have an enlarged end portion for hinged attachment to headers.

Also shown in FIG. 1 is a pile guide 22 located in triangular enlargement 17 and a pile guide 24 located at the end of finger 18. It is to be understood that anchoring pile guides, such as guide 22, may be provided at any convenient location in headers and in fingers and comprise a cylindrical bore throughout the thickness of the header or finger deck portion with the diameter being selected to accommodate an anchoring pile for holding the floatation unit and therefore the dock in place.

As will be explained in more detail hereinafter, the various floating dock units, the headers and the fingers, are hinged to one another utilizing a multilead or piano-type hinge which extends substantially along the entire width of the headers in case of a joint between the headers and along the entire enlarged end portion of a finger in case of a joint between a finger and a header. The construction of the hinge will be explained in connection with a description of FIGS. 5–7 of the drawing.

Figure 2:
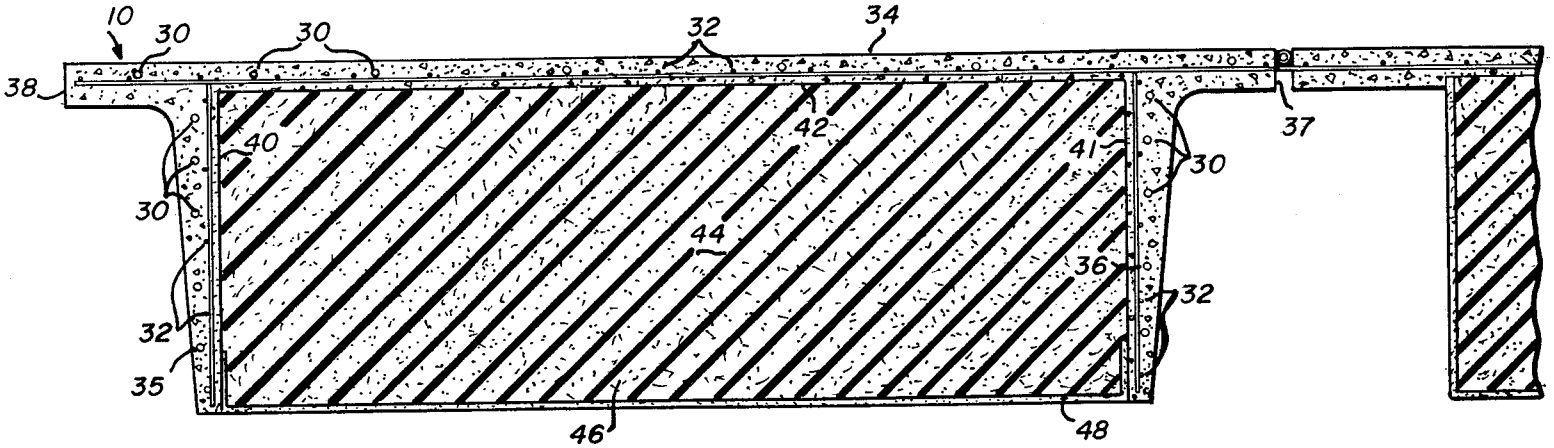
FIGS. 2, 3 and 4 are transverse enlarged sectional views, taken along lines 2—2, 3—3, and 4—4, respectively, of FIG. 1.

As best seen in the cross-sectional view of FIG. 2, header 10 comprises a deck portion 34 and a pair of stem portions 35 and 36 which depend downwardly from the deck portion and which are spaced inwardly from the opposite side edges 37 and 38 of deck portion 34. The resulting configuration can also be referred to as a double-T structural shape, or channel beam with the facing surfaces 40 and 41 of stem portions 35 and 36 defining the sides of a channel 44, the stop of which is formed by the lower surface 42 of the deck portion. Channel 44 is filled with a buoyancy material 46 and the exposed lower and side surfaces of the buoyancy material are coated or covered with a water impregnable layer 48 which may be concrete or an elastoplastic covering or any other well-known water impregnable material.

Headers are cast monolithically of water-proof concrete and around prestressing tendons such as 30, reinforced with wire mesh such as shown at 32. As a practical matter, a header, such as shown in FIG. 2, is constructed in a form having tendons 30 in tension parallel with the form and mesh 32 conveniently tied to the prestressed tendons and held in place thereby. Buoyancy material 46 is cast in its own form and is cladded with layer 48 to produce a substantially water impervious header.

Figure 3:
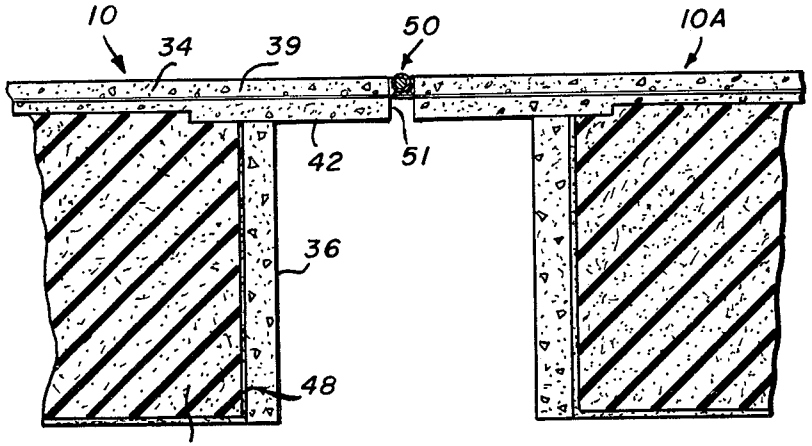

As best seen in FIG. 3, and for a header about 50 feet long, stem 36 extends along the header length to about a distance of one-half foot from end face 51 of deck portion 34, and the thickness of the deck portion increases near end face 51 for additional strength and rigidity near hinge 50 as shown by section 39. As a practical matter, thickened portion 39 may have a length of about one foot and three inches for a header having a length of fifty feet and the thickness of the deck portion increase from about two and one-half inches to about three and one-half inches. As is also best seen in FIG. 3, buoyancy material 46 is coated by layer 48 right up to lower surface 42 of deck portion 34 for maximum protection and extends to a point just short of the end of stem portion 36. FIG. 3 also shows two headers 10 and 10A connected by hinge 50 the details of which will be explained in connection with the description of FIG. 5.

Figure 4:
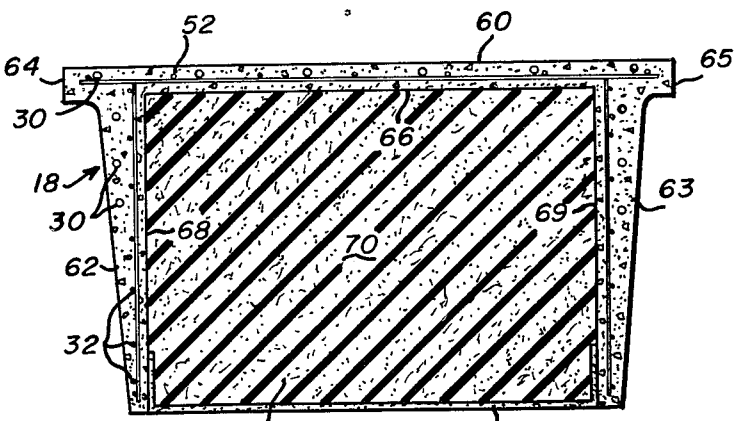

Referring now to FIG. 4, there is shown a cross section of a finger, such as finger 18, which is essentially similar to cross section to the one of header 10 shown in FIG. 2. Finger 10 has a deck portion 60 and stem portions 62 and 63 which include prestressed tendon 30 and a reinforcing wire mesh 32. The cross-sectional shape may also be described as a double-T or channel beam section even though the stem portions are shown to be closer to side surfaces 64 and 65 than the stem portions of the headers.

As a practical matter, the channel formed by lower surface 66 of deck portion 60 and the facing surfaces 68 and 69 of stem portion 62 and 63 form a channel 70 which is filled with a buoyancy material 71 which is cladded for protective reasons with a coating 72. The length of stem portions 62 and 63 and their lateral separation is selected so that the resulting channel 70 can accommodate the proper amount of buoyancy material to assure the desired floatation of the finger.

Figure 5:
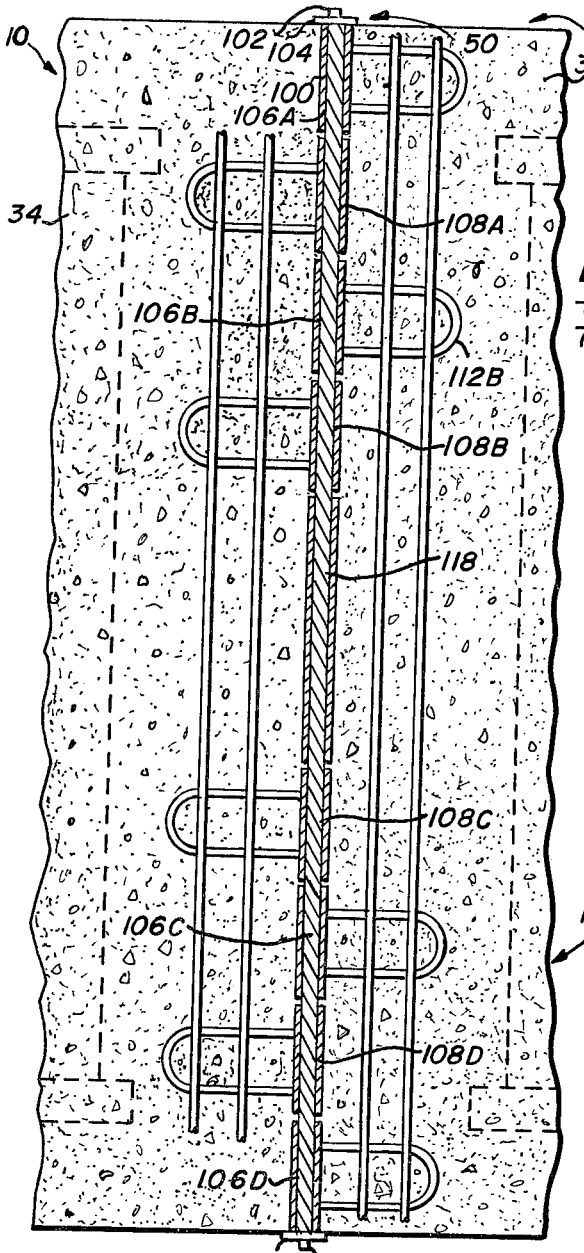
FIG. 5 is an enlarged fragmentary plan view of a hinge between a pair of headers, such as shown in FIG. 1.
Figure 6:
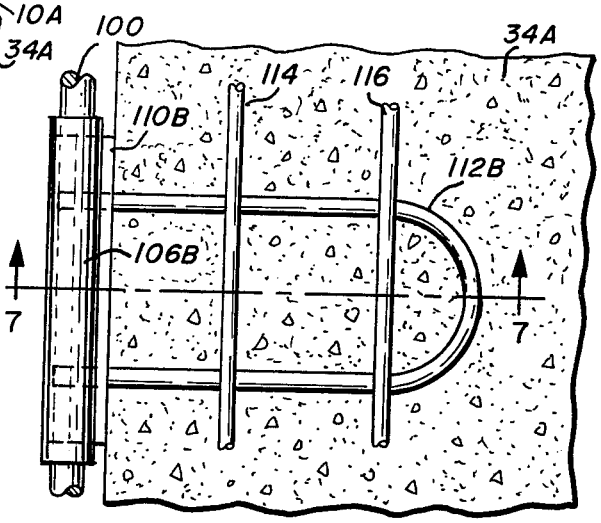
FIG. 6 is a further enlarged fragmentary plan view of a portion of FIG. 5 showing the details of a hinge section.
Figure 7:
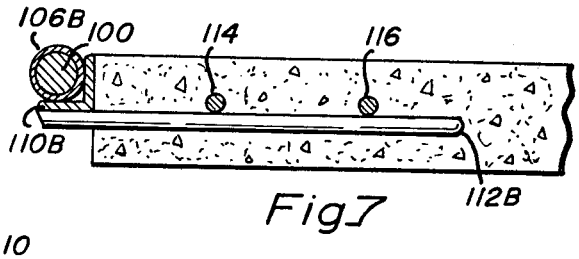
FIG. 7 is a transverse sectional view taken along lines 7—7 of FIG. 6.

Referring now to FIGS 5–7, there is shown an enlarged view of hinge 50 of FIG. 3, connecting together headers 10 and 10A. Hinge 50 comprises a hinge pin 100 which extends across the entire width of header 10 and which is held in place against axial displacement by having both end portions provided with a washer 104 secured by a cotter key 102. Hinge pin 100 is disposed inside a plurality of aligned cylindrical sleeves 106 and 108 which are alternately fastened to header 10 and 10A in a manner to be described, to form a piano or multilead hinge.

More particularly, a plurality of sleeves such as 106A, 106B, 106C and 106D are fastened to header 10 and a like plurality of sleeves 108A, 108B, 108C and 108D are fastened to header 10A. As best seen in FIGS. 6 and 7, a cylindrical sleeve such as sleeve 106B is welded to the inside surfaces of an angle bar 110B which has a length slightly shorter than the length of sleeve 106B. Angle bar 110B, in turn, is welded to a U-shaped loop 112B which is embedded into concrete deck portion 34 when the concrete is poured. For indexing purposes, and to assure that all U-shaped loops 112 lie in a common plane, there are provided a pair of registration bars 114 and 116 which extend along the entire width of a deck portion and which are supported in the form in which the header is poured, the U-shaped loops being attached (welded) to bars 114 and 116. Typically, a U-shaped loop may be a #4 steel bar and the registration bars may be a #3 steel bar. Hinge pin 100 may be a steel bar having a $\frac{7}{8}''$ diameter and angle iron may be typically $1\frac{1}{2}'' \times 1\frac{1}{2}'' \times 3/6''$ iron having a length of 8".

The remaining cylindrical sleeves 106 and 108 are similarly fastened to the end of deck portion 34 of the respective header and the center section is formed by a floating cylindrical sleeve 118 which merely covers the surface of the hinge pin between sleeve 108B and 108C to prevent any damage to the hinge pin and to retain a planar walking surface.

In connection with hinge 50, it should be understood that floater section 118 may be replaced by a plurality of hinged sections, a hinged section comprising a cylindrical sleeve such as 106B fastened to one of the headers either by means of angle bar 110B and loops 112B or equivalent.

Figure 8:
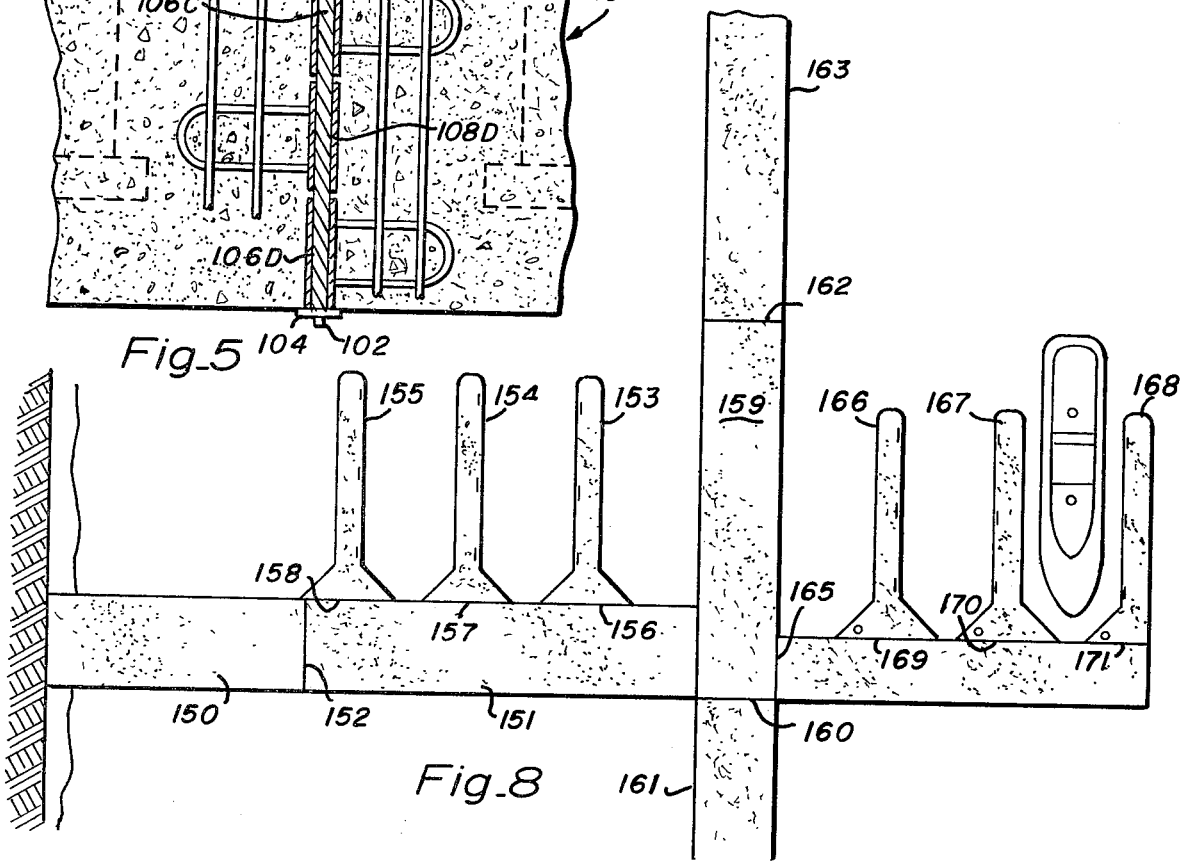
FIG. 8 is a reduced plan view of a layout of a composite dock structure, constructed in accordance with this invention and comprising a plurality of hinged headers and fingers.

Referring now to FIG. 8, there is shown a complete section of a floating dock constructed in accordance with the present invention utilizing a header 150 which is connected to land. The end of header 150 is hinged to the end of another header 151 through a hinge 152 and one side of header 151 is connected to three fingers 153, 154 and 155 through hinges 156, 157 and 158. The other end of header 158 is connected to one side of a header 159 which is connected, on one end, through hinge 160 to a header 161 and on the other end through hinge 162 to header 163. The other side of header 159 is connected to a header which is more narrow in design than the previously mentioned headers, namely 164 through a hinge 165 and to its side are a number of fingers 166, 167 and 168 through hinges 169, 170 and 171. Header 163 can then be connected to other headers as shown. Also, each finger is connected to the header through an enlarged end position.

There has been described a concrete floatation dock which can be constructed of very long sections, which is rigid and therefore has a weight per unit length which may be considerably less than comparable headers or fingers of the flexible variety, i.e., without stems. Each header and finger has a channel formed on the underside by means of the stems which accommodate the floatation material and adjacent headers or fingers are joined, either end to end, or end to side, through hinges which extend along the entire width of either the enlarged end portion of finger or the header.

What is claimed is:

1. A floating concrete dock comprising:

a header in the form of a double-T channel beam, open at both ends and the bottom, consisting of a deck portion and a pair of stem portions depending downwardly and spaced inwardly from the side edges of said deck portion to impart rigidity to said deck portion, said stem portion having walls opposite the facing walls which slope inwardly and having free end portions defining the channel entrance, said deck portion and said stem portions having longitudinal tensioning means maintaining said deck portion and said stem portion under longitudinal compression; and buoyancy material disposed wholly within the open channel defined by said deck portion and said stem portions.

2. A floating concrete dock in accordance with claim 1 further including a plurality of headers, and continuous hinge means connecting the ends of adjacent headers to one another.

3. A floating concrete dock in accordance with claim 2 in which said continuous hinge includes a plurality of U-shaped loops with the closed end horizontally anchored in said deck portion and having a pair of ends projecting outwardly from adjacent ends of said headers, all of said ends lying in a common place;

an angle iron of a selected length affixed to said projecting ends along one surface thereof, the other outside surface being adjacent said header and flush with the top thereof, a tubular body having an interior bore forming a hinge portion extending inside said angle iron and affixed to and along the interior surfaces thereof, adjacent hinge portions being spaced apart along one header with corresponding hinge portions in the other header extending between the aforesaid spaced apart hinge portions; and a hinge pin dimensioned for rotatably engaging said bore extending through the individual hinge portion substantially along the entire width of said header.

4. A floating concrete dock in accordance with claim 1 further including at least one finger, said finger having a configuration substantially the same as a header except that it is smaller in size and has an enlarged end portion at one end of the deck portion, and continuous hinge means connecting the edge of said enlarged end portion to the side of a header.

5. A floating concrete dock in accordance with claim 1 further including a layer of water impregnable material covering the surface of the buoyance material exposed to water to seal said buoyancy material.

6. A floating concrete dock in accordance with claim 5 in which said water impregnable material is concrete.

7. A floating concrete dock in accordance with claim 5 in which said impregnable material is an elastoplastic.

8. A floating concrete dock in accordance with claim 1 further including cylindrical openings in said deck portion having a diameter selected to accommodate an anchoring pile.

* * * * *